US006854959B2

(12) United States Patent
Barb

(10) Patent No.: US 6,854,959 B2
(45) Date of Patent: Feb. 15, 2005

(54) MIXED TUNED HYBRID BUCKET AND RELATED METHOD

(75) Inventor: Kevin Joseph Barb, Halfmoon, NY (US)

(73) Assignee: General Electric Company, Schenectady, NY (US)

( * ) Notice: Subject to any disclaimer, the term of this patent is extended or adjusted under 35 U.S.C. 154(b) by 14 days.

(21) Appl. No.: 10/249,518

(22) Filed: Apr. 16, 2003

(65) Prior Publication Data

US 2004/0208741 A1 Oct. 21, 2004

(51) Int. Cl.[7] ..... F01D 5/16

(52) U.S. Cl. ..... 416/1; 416/715; 416/203; 416/229 A; 416/236 R; 416/241 A; 416/500

(58) Field of Search ..... 415/1, 119; 416/1, 416/175, 203, 229 A, 236 R, 241 A, 500

(56) References Cited

U.S. PATENT DOCUMENTS 4,097,192 A * 6/1978 Kulina ..... 416/175
5,720,597 A 2/1998 Wang et al.
5,931,641 A 8/1999 Finn et al.
5,947,688 A 9/1999 Schilling et al.
6,033,186 A 3/2000 Schilling et al.
6,039,542 A 3/2000 Schilling et al.
6,042,338 A 3/2000 Brafford et al.
6,139,278 A 10/2000 Mowbray et al.
6,287,080 B1 9/2001 Evans et al.

FOREIGN PATENT DOCUMENTS

EP 1 152 123 A2 11/2001

* cited by examiner

*Primary Examiner*—Ninh H. Nguyen
(74) *Attorney, Agent, or Firm*—Nixon & Vanderhye P.C.

(57) ABSTRACT

A steam turbine rotor wheel includes a plurality of buckets secured about a circumferential periphery of the wheel, each bucket comprising a shank portion and an airfoil portion, the plurality of buckets including two groups of buckets having respective different predetermined resonant frequencies. A method of reducing vibration in a row of buckets on a steam turbine rotor wheel includes a) providing a first group of buckets with a first predetermined natural frequency range; b) providing a second group of buckets with a second predetermined natural frequency range different than the first predetermined natural frequency range; and c) assembling buckets of the first and second groups of buckets in alternating fashion on the rotor wheel.

18 Claims, 5 Drawing Sheets

MIXED TUNED HYBRID BUCKET AND RELATED METHOD

BACKGROUND OF INVENTION

This invention relates generally to steam turbine buckets (or blades) and, more particularly, to composite buckets specifically tuned to provide different predetermined frequency damping characteristics and improved system damping.

Steam turbine buckets operate in an environment where they are subject to high centrifugal loads and vibratory stresses. Vibratory stresses increase when bucket natural frequencies become in resonance. The magnitude of vibratory stresses when a bucket vibrates in resonance is proportional to the amount of damping present in the system (damping is comprised of material, aerodynamic and mechanical components), as well as the vibration stimulus level. For continuously coupled buckets, the frequency of vibration is a function of the entire system of blades in a row, and not necessarily that of individual blades within the row.

At the same time, centrifugal loads are a function of the operating speed, the mass of the bucket, and the radius from engine centerline where that mass is located. As the load (mass) of the bucket increases, the physical area or cross-sectional area must increase at lower radial heights to be able to carry the mass above it without exceeding the allowable stresses for the given material. This increasing section area of the bucket at lower spans contributes to excessive flow blockage at the root and thus lower performance. The weight of the bucket contributes to higher disk stresses and thus to potentially reduced reliability.

Several prior U.S. patents relate to so-called "hybrid" bucket designs where portions of the airfoil portion are composed of a combination of a metal and a polymer filler material. These prior patents include U.S. Pat. Nos. 6,139,278; 6,042,338; 5,931,641 and 5,720,597.

SUMMARY OF INVENTION

This invention proposes a means of suppressing the aero-elastic response of a bucket or blade row (continuously coupled or free-standing) via mixed-tuning of the natural frequencies of the blades or buckets within the row. Specifically, this patent utilizes the hybrid bucket concept as disclosed in U.S. Pat. No. 5,931,641, but extends that concept to include optimization of internal pocket configurations within the airfoil portions of the buckets so as to produce, in the exemplary embodiment, two groups or populations of buckets, each with the same external aerodynamic shape and profile, but with different internal rib and/or pocket geometries that produce different bucket resonant frequencies. The pockets within the airfoil portions of the buckets are preferably filled with a polymer filler material that also forms one face of the airfoil portion of the bucket. By intentionally altering the natural frequencies of the two groups of buckets, the buckets may be purposefully and logically assembled so as to utilize this inherent difference in natural resonant frequencies as a means of damping the system response to synchronous and non-synchronous vibrations, without adversely affecting the aerodynamic properties of the buckets.

In the exemplary embodiment, two groups or sets of buckets with different internal pocket configurations, along the pressure sides of the buckets are assembled, within a single row of buckets, on a rotor wheel of a steam turbine. One group of buckets is designed to have higher resonance frequencies than the other. Once the bucket configurations are determined, the buckets are assembled on the wheel in a pattern that best achieves the goal of vibration suppression. In the exemplary embodiment, the buckets of each group assembled on the wheel in alternating fashion, i.e., each bucket of one group is adjacent a bucket of the other group. Other arrangements, however, are contemplated that remain within the scope of the invention.

Because an overall weight reduction of up to about 30% in the bucket is achievable with hybrid buckets, attachment stresses can be reduced and reliability improved, without changing the aerodynamic characteristics of the airfoil portion.

Accordingly, in its broader aspects, the invention relates to a steam turbine rotor wheel comprising a plurality of buckets secured about a circumferential periphery of the wheel, each bucket comprising a shank portion and an airfoil portion, the plurality of buckets including two groups of buckets having respective different predetermined natural resonant frequencies.

In another aspect, the invention relates to a steam turbine rotor wheel comprising a row of buckets secured about a circumferential periphery of the wheel, the row of buckets including two groups of buckets, arranged in an alternating pattern about the periphery of the wheel, each group having discrete means for reducing amplitude of vibration in the row of buckets.

In another aspect, the invention relates to a method of reducing vibration in a row of buckets on a steam turbine rotor wheel comprising: a) providing a first group of buckets with a first predetermined natural frequency range; b) providing a second group of buckets with a second predetermined natural frequency range different than the first predetermined natural frequency range; and c) assembling buckets of the first and second groups of buckets in alternating fashion on the rotor wheel.

The invention will now be described in detail in connection with the drawings identified below.

DETAILED DESCRIPTION

Figure 1:
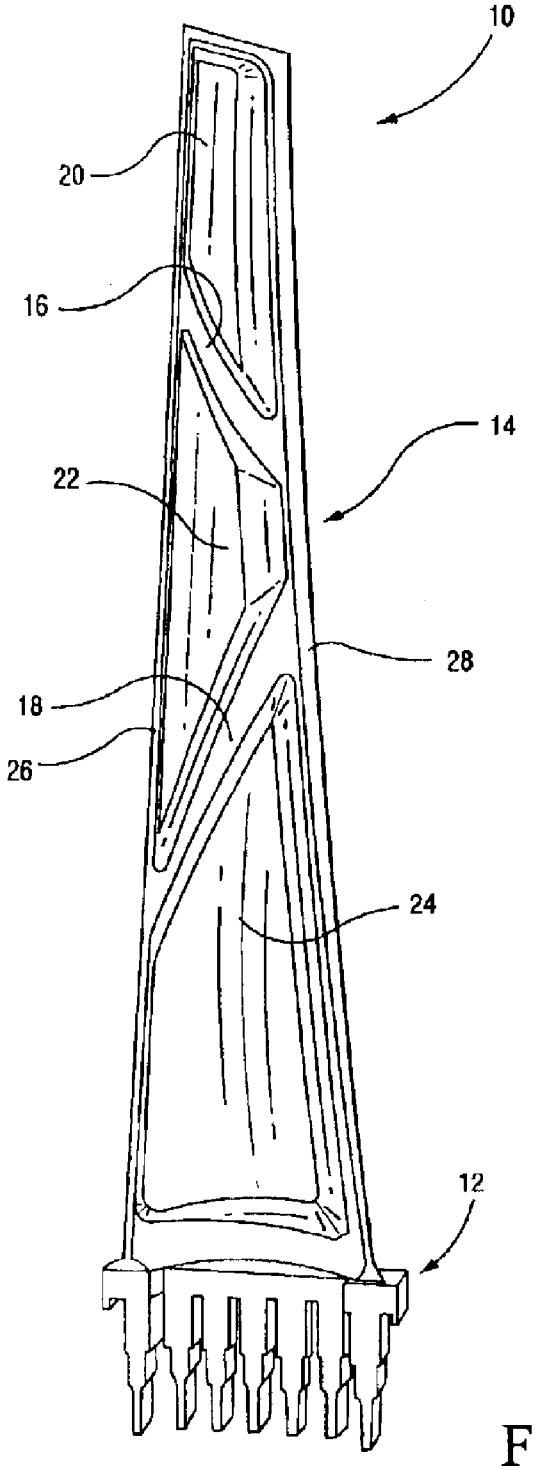
FIG. 1 is a perspective view of a partially manufactured bucket in accordance with the present invention.
Figure 2:
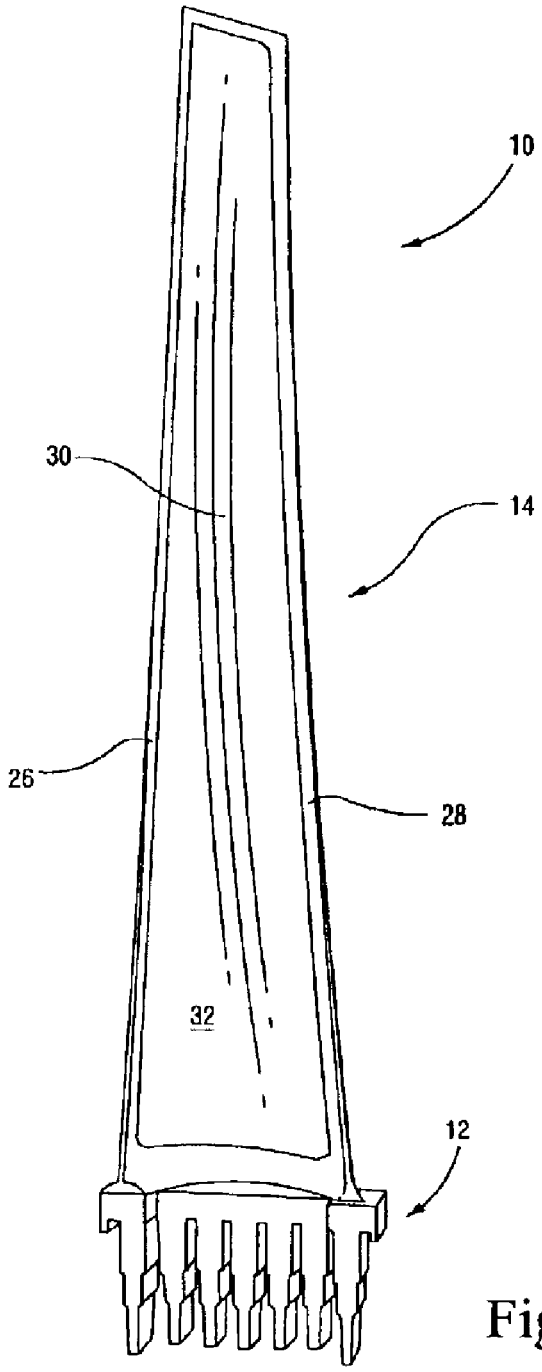
FIG. 2 is a perspective view of the bucket shown in FIG. 1 but after the polymer filler material is added to the bucket.

With reference to FIG. 1, a steam turbine bucket 10 is shown in partially manufactured form. The bucket 10 includes a shank portion 12 and an airfoil portion 14. This invention is concerned with the airfoil portion that is preferably constructed of steel or titanium but other suitable materials include aluminum, cobalt or nickel. Ribs 16, 18 are integrally cast with the airfoil portion to form discrete pockets 20, 22 and 24. It will be appreciated, however, that the ribs do not extend flush with the side edges 26, 28 of the airfoil portion. The rib height may in fact vary according to specific applications. Polymer based filler material 30 as described in U.S. Pat. No. 5,931,641 is cast-in-place over the pressure side of the airfoil, filling the pockets 20, 22 and 24 and covering the ribs to thereby form a smooth face 32 on the pressure side of the bucket, as shown in FIG. 2. Specifically, the filler material 30 may consist essentially of an elastomer, such as poly(dimethylsiloxane). Other suitable choices for the elastomer include, without limitation, poly (diphenyldi-methylsiloxane), poly(flurosiloxanes), Viton, polysulfide, poly(thiolether), and poly(phosphzenes).

The choice for bonding the filler material 30 to the metal surface of the airfoil portion includes, without limitation, self adhesion, adhesion between the filler material 30 and the metal surface of the airfoil portion, adhesive bonding (adhesive film or paste), and fusion bonding.

It is further noted that when an elastomer is used as filler material, the elastomer preferably has an average modulus of elasticity of between generally 250 pounds-per-square-inch (psi) and generally 50,000 pounds-per-square-inch (psi) (and more preferably between generally 250 psi and generally 20,000 psi) over the operating temperature range. An elastomer that is too soft (i.e., having an average modulus of elasticity less than generally 250 psi) may not be able to structurally provide an airfoil shape, and an elastomer that is too hard (i.e., having an average modulus of elasticity greater than generally 50,000 psi) may not be able to be manufactured to required close tolerances. A more preferred range for the average modulus of elasticity is between generally 500 psi and generally 15,000 psi. In some applications a conventional skin (not shown) and a conventional erosion coating (not shown) may cover the exposed surfaces of the airfoil portion 14 of the bucket.

In the above described embodiment, the ribs 16, 18 are shown as angled in opposite directions along the length of the airfoil portion 14, but other arrangements are within the scope of this invention as well.

Figure 3:
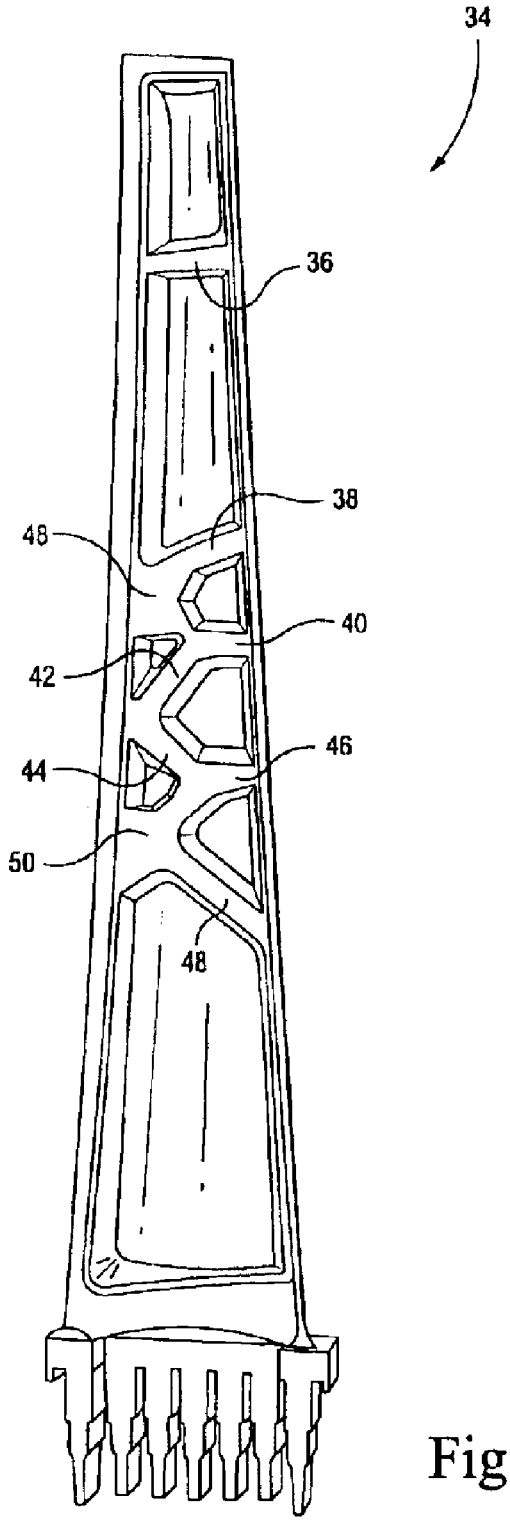
FIG. 3 is a perspective view of a partially completed bucket showing another configuration in accordance with the invention.

Turning to FIG. 3, another bucket 34 is shown to include a more intricate set of ribs 36, 38, 40, 42, 44, 46 and connecting web portions 48, 50. The ribs are concentrated near the radial center of the airfoil portion, and form a correspondingly greater number of pockets. When the filler material 30 is cast in place, however, the bucket 34 will otherwise have the same outward appearance as the bucket 10 shown in FIG. 2.

Figure 4:
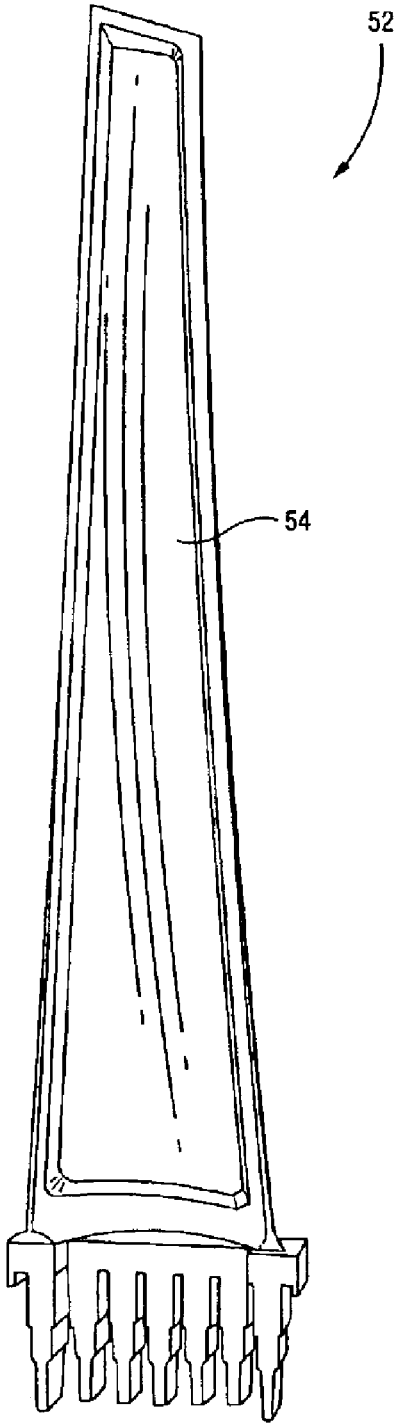
FIG. 4 is a perspective view of a partially completed bucket showing still another configuration in accordance with the invention.

Turning now to FIG. 4, still another embodiment of a tuned bucket is illustrated. Here, the bucket 52 is formed without ribs, but rather with a single large pocket 54, the entirety of which will be filled by the polymer-based filler material 30.

Figure 5:
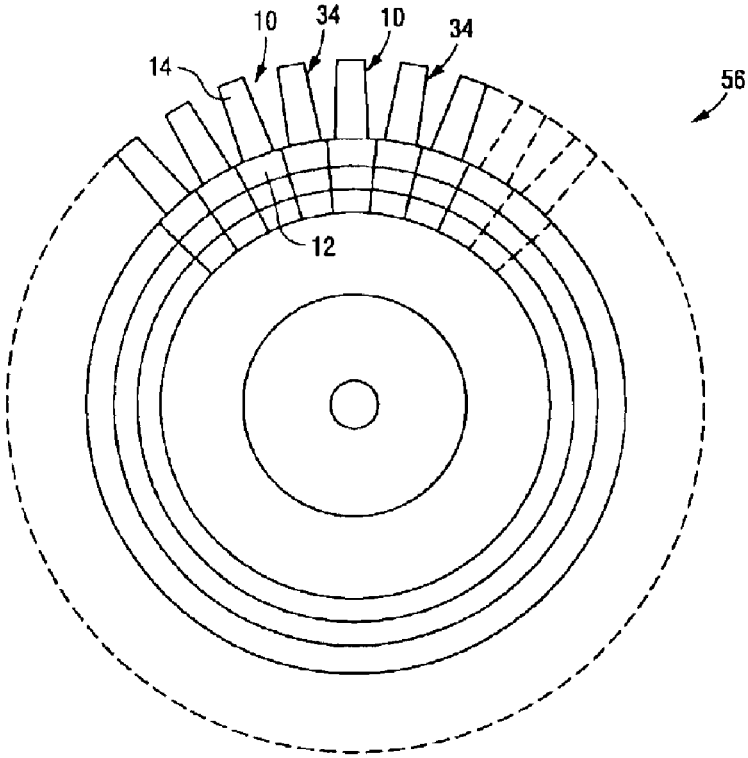
FIG. 5 is a schematic axial elevation view of a turbine wheel with mounted buckets.

In an exemplary embodiment, the bucket designs described above could be utilized to form a row of buckets on a steam turbine rotor wheel 56 as illustrated in FIG. 5. Specifically, groups A and B (comprised of, e.g., buckets 10 and 34, respectively) would be assembled on the turbine wheel 56 in alternating fashion, i.e., in the pattern ABAB . . . , such that a bucket of one group is always adjacent a bucket of the other group. The buckets A, B may have other internal pocket configurations than those described herein, so as to produce the desired vibration frequency differential. It is also possible to vary the pattern of bucket group distribution, again so as to achieve the desired frequency damping characteristics. For example, a pattern AABBAA . . . etc. might also be employed.

In particular, with this invention, there exists the potential to design one group of buckets where the natural frequency is equally disposed between two "per-rev" criteria (4 per rev and 5 per rev split for example), and to design the other group of buckets with a different rib or pocket configuration so as to be equally disposed about another set of "per-rev" stimuli (such as a 3 per rev and 4 per rev split). Analysis has shown that a bucket's natural frequencies can be modified significantly (+/−10% or more) via modifications in the internal rib configuration and/or pocket geometry.

Thus, the present invention permits blades to be manufactured specifically to achieve different natural frequencies rather than being selected based upon "as manufactured" natural frequencies. The mixed turning of the buckets' individual natural frequencies reduces the amplitude of vibration of the entire row of blades by damping the system response to synchronous and non-synchronous vibrations without adversely affecting the aerodynamic properties of the blade design.

Another important consideration is the reduction of mass enabled by the use of the polymer-based filler material 30. For example, with a blade configured generally as shown in FIGS. 1 and 3, about 30% reduction in the weight of the bucket can be achieved. Such weight reduction, without alteration of the aerodynamic definition of the airfoil portion, reduces attachment stresses and thereby improves reliability. Low cycle fatigue life may be improved and risk of stress corrosion cracking reduced.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A steam turbine rotor wheel comprising a plurality of buckets secured about a circumferential periphery of the wheel, each bucket comprising a shank portion and an airfoil portion, said plurality of buckets including two groups of buckets having respective different predetermined resonant frequencies, wherein the buckets of one group have airfoil portions with at least one recessed pocket and the airfoil portions of the buckets of the other group have at least one differently configured pocket, and further wherein said pockets are filled with polymer filler material.

2. The steam turbine rotor wheel of claim 1 wherein the buckets of one group alternate about the periphery of the wheel with buckets of the other group, such that any bucket of one group is adjacent a bucket of the other group.

3. The steam turbine rotor wheel of claim 2 wherein the buckets of one group each have a single pocket in the airfoil portion thereof.

4. The steam turbine rotor wheel of claim 3 wherein the buckets of said other group have plural pockets in the airfoil portions thereof.

5. The steam turbine rotor wheel of claim 1 wherein said polymer filler material chosen from a group consisting essentially of poly(dimethylsiloxane), poly(diphenyldimethylsiloxane), poly(flurosiloxanes), Viton™, polysulfide, poly(thiolether), and poly(phosphzenes).

6. The steam turbine rotor wheel of claim 1 wherein said polymer filler material has an average modulus of elasticity of between 250 psi and 50,000 psi.

7. The steam turbine rotor wheel of claim 1 wherein said polymer filler material has an average modulus of elasticity of between 250 psi and 20,000 psi.

8. The steam turbine rotor wheel of claim 1 wherein said polymer filler material has an average modulus of elasticity of between 500 psi and 15,000 psi.

9. The steam turbine rotor wheel of claim 1 wherein said polymer filler material comprises poly (dimethylsiloxane), and said metal comprises titanium.

10. The steam turbine rotor wheel of claim 1 wherein a polymer filler material fills said pockets and forms an exterior face of said airfoil portion.

11. The steam turbine rotor wheel of claim 10 wherein said face lies on a pressure side of said airfoil portion.

12. The steam turbine rotor wheel of claim 1 wherein said groups of buckets are arranged in an alternating pattern about the periphery of the wheel.

13. A steam turbine rotor wheel comprising a row of buckets secured about a circumferential periphery of the wheel, said row of buckets including two groups of buckets, arranged in an alternating pattern about the periphery of the wheel, each group having discrete means for reducing amplitude of vibration in the row of buckets.

14. A method of reducing vibration in a row of buckets on a steam turbine rotor wheel comprising:

a) providing a first group of buckets with a first predetermined natural frequency range;

b) providing a second group of buckets with a second predetermined natural frequency range different than said first predetermined natural frequency range; and c) assembling buckets of the first and second groups of buckets in alternating fashion on the rotor wheel; wherein the first and second predetermined natural frequency ranges are achieve via differently-shaped recessed pockets in respective airfoil portions of the first and second groups of buckets; further wherein said pockets are filled with a polymer filler material.

15. The method of claim 14 wherein said polymer filler material is chosen from a group consisting essentially of poly(dimethylsiloxane), poly(diphenyldi-methylsiloxane), poly(flurosiloxanes), Viton™, polysulfide, poly(thiolether), and poly(phosphzenes).

16. The method of claim 14 wherein said polymer filler material has an average modulus of elasticity of between 250 psi and 50,000 psi.

17. The method of claim 14 wherein said polymer filler material has an average modulus of elasticity of between 250 psi and 20,000 psi.

18. The method of claim 14 wherein said polymer filler material has an average modulus of elasticity of between 500 psi and 15,000 psi.

* * * * *